US010573157B2

(12) United States Patent
Farooqui et al.

(10) Patent No.: US 10,573,157 B2
(45) Date of Patent: Feb. 25, 2020

(54) INTEGRATED 3D PRINTED WIRELESS SENSING SYSTEM FOR ENVIRONMENTAL MONITORING

(71) Applicant: KING ABDULLAH UNIVERSITY OF SCIENCE AND TECHNOLOGY, Thuwal (SA)

(72) Inventors: Muhammad Fahad Farooqui, Thuwal (SA); Atif Shamim, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 16/308,609

(22) PCT Filed: Jun. 13, 2017

(86) PCT No.: PCT/IB2017/053515
§ 371 (c)(1),
(2) Date: Dec. 10, 2018

(87) PCT Pub. No.: WO2017/216729
PCT Pub. Date: Dec. 21, 2017

(65) Prior Publication Data

US 2019/0156647 A1 May 23, 2019

Related U.S. Application Data

(60) Provisional application No. 62/349,793, filed on Jun. 14, 2016.

(51) Int. Cl.

| | |
|---|---|
| ***G08B 21/12*** | (2006.01) |
| ***G08B 17/00*** | (2006.01) |
| ***G08B 21/18*** | (2006.01) |
| ***G08B 25/10*** | (2006.01) |
| ***G08B 19/00*** | (2006.01) |

(52) U.S. Cl.
CPC ..... *G08B 21/12* (2013.01); *G08B 17/005* (2013.01); *G08B 19/00* (2013.01); *G08B 21/182* (2013.01); *G08B 25/10* (2013.01)

(58) Field of Classification Search
None
See application file for complete search history.

(56) References Cited

U.S. PATENT DOCUMENTS

2016/0134327 A1* 5/2016 Joshi ..... H04B 1/707 375/146

OTHER PUBLICATIONS

Czyżewski, J., et al., "Rapid Prototyping of Electrically Conductive Components Using 3D Printing Technology," Journal of Materials Processing Technology, Jul. 2009, vol. 209, No. 12-13, pp. 5281-5285.

International Search Report in related International Application No. PCT/IB2017/053515, dated Sep. 28, 2017.

(Continued)

*Primary Examiner* — Adolf Dsouza
(74) *Attorney, Agent, or Firm* — Patent Portfolio Builders PLLC

(57) ABSTRACT

A wireless sensor device includes a computing device, printable circuitry, sensors, and antennas formed on one or more panels. The wireless sensor device may be configured to take environment measurements, such as temperature, gas, humidity, and wirelessly communicate the environment measurements to a remote computing device.

19 Claims, 5 Drawing Sheets

Dimensions: 2 cm x 2 cm x 2 cm

(56) References Cited

OTHER PUBLICATIONS

Nassar, I.T., et al., "Development of Novel 3-D Cube Antennas for Compact Wireless Sensor Nodes," IEEE Transactions on Antennas and Propagation, Feb. 3, 2012, vol. 60, No. 2, pp. 1059-1065.
Vyas, R., et al., "Inkjet Printed, Self Powered, Wireless Sensors for Environmental, Gas, and Authentication-Based Sensing," IEEE Sensors Journal, Dec. 2011, vol. 11, No. 12, pp. 3139-3152.
Written Opinion of the International Searching Authority in related International Application No. PCT/IB2017/053515, dated Sep. 28, 2017.
Wu, S.-Y., et al., "3D-Printed Microelectronics for Integrated Circuitry and Passive Wireless Sensors," Microsystems & Nanoengineering, Jul. 20, 2015, vol. 1, 2015013.

* cited by examiner

INTEGRATED 3D PRINTED WIRELESS SENSING SYSTEM FOR ENVIRONMENTAL MONITORING

CROSS REFERENCE TO RELATED APPLICATION

This application is a U.S. National Stage of International Application No. PCT/IB2017/053515, filed on Jun. 13, 2017, which claims the benefit of, and priority to, U.S. Provisional Patent Application No. 62/349,793, entitled "INTEGRATED 3D PRINTED WIRELESS SENSING SYSTEM FOR ENVIRONMENTAL MONITORING" filed on Jun. 14, 2016, the disclosures of which are incorporated herein by reference in their entirety.

BACKGROUND

Calamities such as forest fires and industrial leaks pose a major threat to the human population. Often times, an environment threat is discovered by a person in the area. In response, an emergency team is notified to address the environmental threat.

SUMMARY

Various aspects of the present disclosure are related to methods and systems for monitoring environmental conditions such as, e.g., temperature, humidity, and gas levels in an area.

According to one aspect, among others, an apparatus is provided comprising a computing device; a wireless transmitter coupled to the computing device; a fully inkjet-printed sensor coupled to at least one of a plurality of side panels of the apparatus, the fully inkjet-printed sensor being in data communication with the computing device. The fully inkjet-printed sensor can be used to monitor an environmental condition. The apparatus can further comprise an antenna printed on at least one of the plurality of side panels, and the antenna is coupled to the wireless transmitter. The wireless transmitter via the antenna can be configured to provide wireless communication of the environmental condition to a remote computing device.

In addition, in various aspects of the present disclosure, the environmental condition can be temperature, and the fully inkjet-printed sensor can comprise a resistive sensor that is formed by printing polymer ink. In another aspect, among others, the environmental condition can be a gas level, and the fully inkjet-printed sensor can comprise a resistive sensor that is formed by printing carbon nanotube ink. Additionally, the apparatus can further comprise a circuit board panel attached to each of the plurality of side panels and an air capacitive sensor coupled to the circuit board, the air capacitive sensor being configured to monitor humidity.

According to one aspect, among others, a method of assembling a wireless sensor device for monitoring an environmental condition comprises printing, using an inkjet printer, an enclosure comprising a plurality of side panels. Printing the enclosure can comprise printing a temperature sensor and a gas sensor onto at least one of the plurality of side panels and printing an antenna onto at least one of the plurality of side panels. The method can further comprise attaching the plurality of side panels to a circuit board panel that comprises a computing device and a wireless transmitter, where attaching the plurality of side panels aligns a first electrical connection associated with the circuit board panel to a second electrical connection associated with the plurality of side panels. The computing device can be in data communication with the temperature sensor, the gas sensor, and/or the wireless transmitter. The wireless transmitter can be coupled to the antenna.

In addition, in various aspects of the present disclosure, the method can further comprise attaching an air capacitor sensor to the circuit board panel, the air capacitor sensor being configured to measure humidity. In one aspect, among others, the air capacity sensor can comprise an air cavity.

In another aspect, among others, the inkjet printer can comprise a 3D inkjet printer, and the temperature sensor and the gas sensor can be entirely fabricated using the 3D inkjet printer. In another aspect, among others, the plurality of side panels can be substantially the same dimensions.

According to one aspect, among others, an system is provided comprising a wireless transmitter; an enclosure at least partially formed from a plurality of side panels; an inkjet-printed sensor coupled to at least one of the plurality of side panels, the inkjet-printed sensor being used to provide a measurement of an environmental condition; and a computing device coupled to the wireless transmitter and the inkjet-printed sensor. The computing device can be configured to transmit, via the wireless transmitter, the measurement to a remote computing device.

In various aspects of the present disclosure, the enclosure can comprise a cube shape. Additionally, the system can further comprise a circuit board panel coupled to the plurality of side panels. In one aspect, among others, the system can further comprise an air capacitive sensor electrically coupled to the computing device. In some aspects, among others, the air capacitive sensor can be coupled to the circuit board panel.

In the various aspects, the system can further comprise an antenna printed on at least one of the plurality of side panels, the antenna being coupled to the wireless transmitter. In one aspects, among others, the computing device can be configured to determine that the measurement exceeds a threshold associated with the environment condition. In another aspect, among others, the inkjet-printed sensor can be printed onto the at least one of the plurality of side panels via polymer ink. Additionally, the plurality of side panels can be formed by folding at least one panel.

In the various aspects, the inkjet-printed sensor can be coupled to the at least one of the plurality of side panels via adhesive tape. In one aspect, among others, the system can further comprise a printed battery coupled to the at least one of the plurality of side panels, the printed battery being electrically coupled to the computing device and the wireless transmitter.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAIL DESCRIPTION

Disclosed herein are various embodiments of methods and systems related to monitoring environmental conditions, such as temperature, humidity, and gas levels in an area. For example, the various embodiments of the present disclosure involve monitoring environmental conditions and wirelessly communicating an environmental alert to a remote computing device in response to an environmental measurement reaching a threshold. The environmental alert can be transmitted as an early warning to environmental threats such as industrial leaks, forest forests, and other environmental threats. Thus, the embodiments can be used to monitor environmental conditions in real-time, which enables a response team to respond faster to an environment threat. In addition, the various embodiments in the present disclosure can be manufactured in a low-cost fashion and in a small form-factor. As result, these benefits can enable wide spread use of wireless environmental monitoring systems. In particular, inkjet printing can be useful because of its digitally controlled additive nature of depositing material on a variety of substrates. In the various embodiments, the sensors, the enclosure, and the circuit board can be fabricated using additive manufacturing technology, such as 3D inkjet printing technology.

The present disclosure of the various embodiments has several advantages over existing implementations. For example, the benefits of lowering cost and reducing the size of prior solutions enables wireless monitoring functionality to be placed in a greater number of locations. In turn, a larger network of wireless environmental monitoring systems can provide environmental response teams with quicker alerts to environmental threats as they develop, which enable these response teams to save additional human lives and further minimize damage to the environment.

In the following paragraphs, the embodiments are described in further detail by way of example with reference to the attached drawings. In the description, well known components, methods, and/or processing techniques are omitted or briefly described so as not to obscure the embodiments. Turning now to the drawings, a general description of exemplary embodiments of a wireless sensor system for environmental monitoring and its components are provided, followed by a discussion of the operation of the system.

Figure 1:
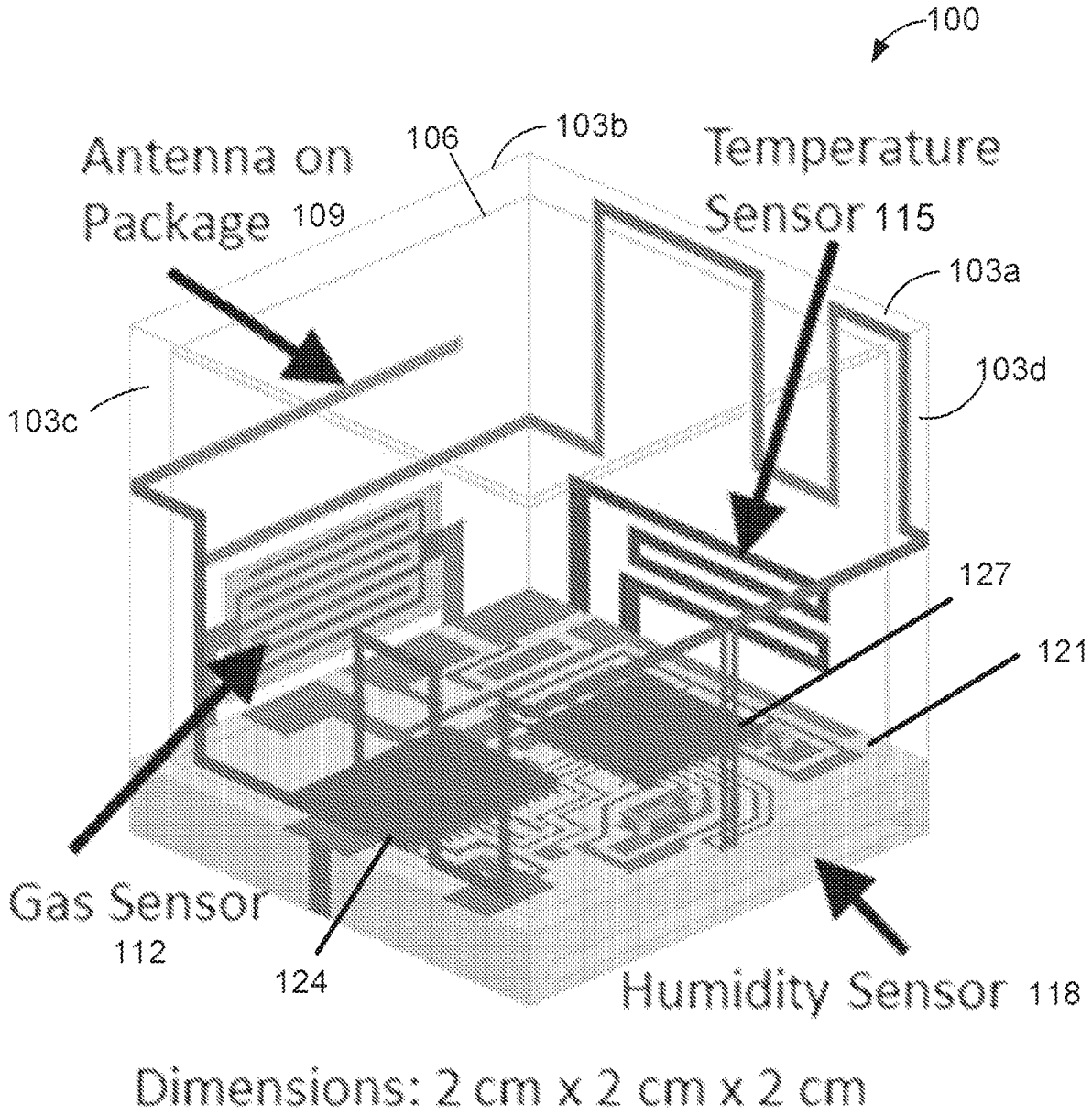
FIG. 1 illustrates an example wireless environmental monitoring system, according to various embodiments of the present disclosure.

With reference to FIG. 1, shown is an example wireless environmental monitoring system 100. The wireless environmental monitoring system 100 includes a first side panel 103*a*, a second side panel 103*b*, a third side panel 103*c*, and a fourth side panel 103*d* (collectively the "side panels 103"). As illustrated, the side panels 103 can be connected to each other. Ultimately, the side panels 103 can be used to form a cubed-shaped enclosure. As one skilled in the art can appreciate, the side panels 103 can be comprise different dimensions and used to form enclosures of various shapes and dimensions. In some embodiments, the enclosure, comprising the side panels 103, can be fabricated as a single integrated structure using 3D inkjet printing. In other embodiments, the side panels 103 can be formed from folding one or more panels. Electronic components can be coupled to one or more of the side panels 103 using 3D inkjet printing technology. In other words, the wireless environmental monitoring system 100 can comprise various circuits and electronic components printed on each side panel 103. The side panels 103 can comprise paper, plastic, silicon, polymer, or other suitable materials.

The electronic components can be printed using an inkjet printer. In some embodiments, the electronic components (e.g., the sensors) can be printed on adhesive tape, and the adhesive tape can be attached to the side panels 103. The electronic components can be printed with silver nanoparticles based ink. The electronic components can be removable from the side panels 103. In addition, the wireless environmental monitoring system 100 also includes an antenna 109, a gas sensor 112, a temperature sensor 115, and a humidity sensor 118, which can all be electrically coupled to a printed circuit board 121.

As may be appreciated, a circuit and/or antenna can be printed using relatively inexpensive inkjet and/or screen printing technology. For example, an inkjet printer can utilize conductive ink to print a complete and/or partial circuit on a side panel 103, the circuit capable of being combined with additional circuitry. Conductive ink can comprise, for example, ink comprising conductive nanoparticles, nanotubes, and/or other conductive materials such as gold, silver, copper, silicon, and/or any combination thereof. As may be appreciated, various paper and/or plastic substrates can be used to flex and/or bend without damaging the circuit and can be selected to be environmentally friendly. In the case of an inkjet printer, the thickness of the substrate can be selected for use in the printer.

As shown in FIG. 1, the antenna 109 is printed across multiple side panels 103. In addition, the antenna 109 is electrically coupled to the printed circuit board 121, and in turn to a wireless transceiver 124. The wireless transceiver 124 can be configured to communicate using a wireless protocol, such as the IEEE 802.15.4 standard (Zigbee), a Bluetooth protocol, a proprietary protocol, or other suitable wireless protocols. The antenna 109 can be configured to radiate energy substantially equally in all directions (e.g., omnidirectional). As such, the wireless environmental monitoring system 100 can wirelessly communicate to a remote computing device regardless of its orientation. In other implementations, the antenna 109 can be designed for unidirectional communications. In the illustrated embodiment, a computing device is embedded within the wireless transceiver 124 (e.g., Texas Instruments CC2530). In other embodiments, the wireless transceiver 124 and the computing device can be configured as separate electronic circuit devices.

Figure 4:
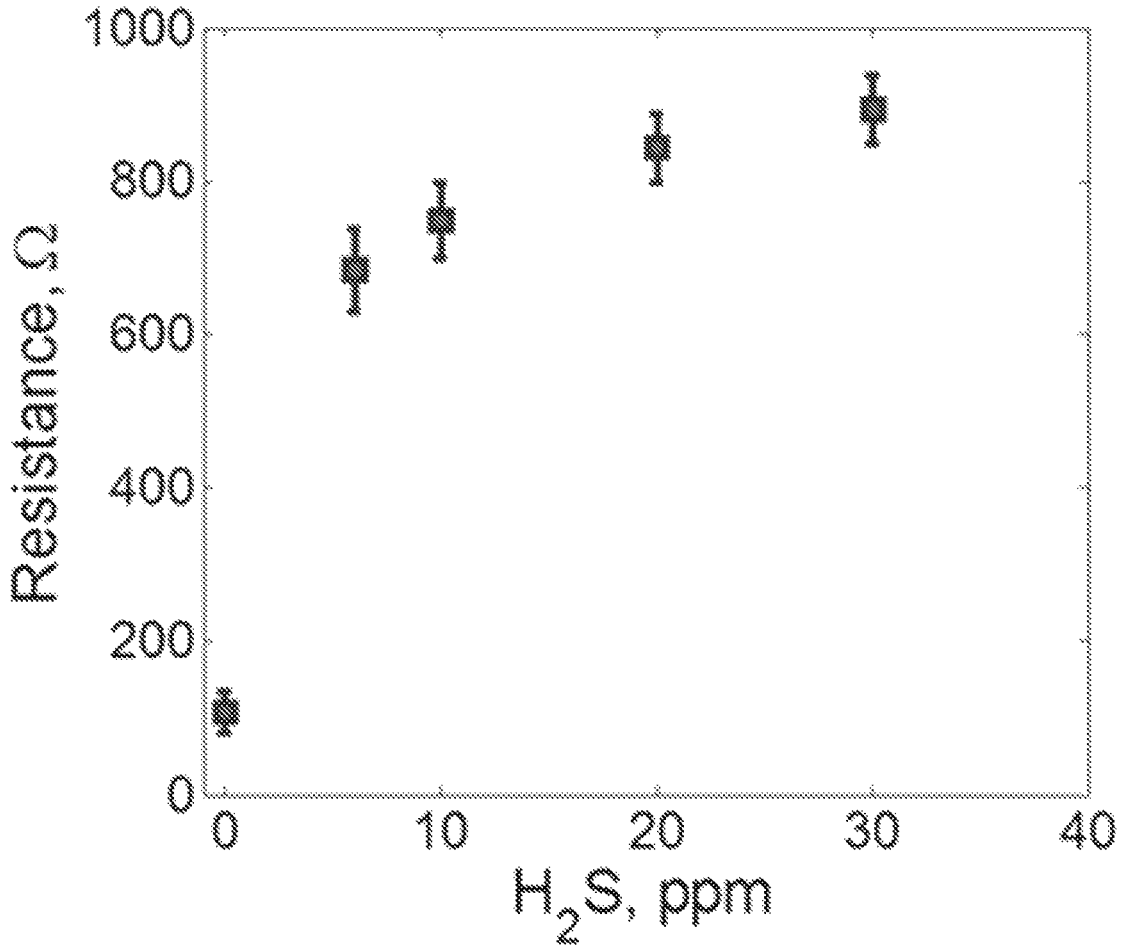
FIG. 4 illustrates a characterization of a gas sensor of the wireless environmental monitoring system, according to various embodiments of the present disclosure.
Figure 5:
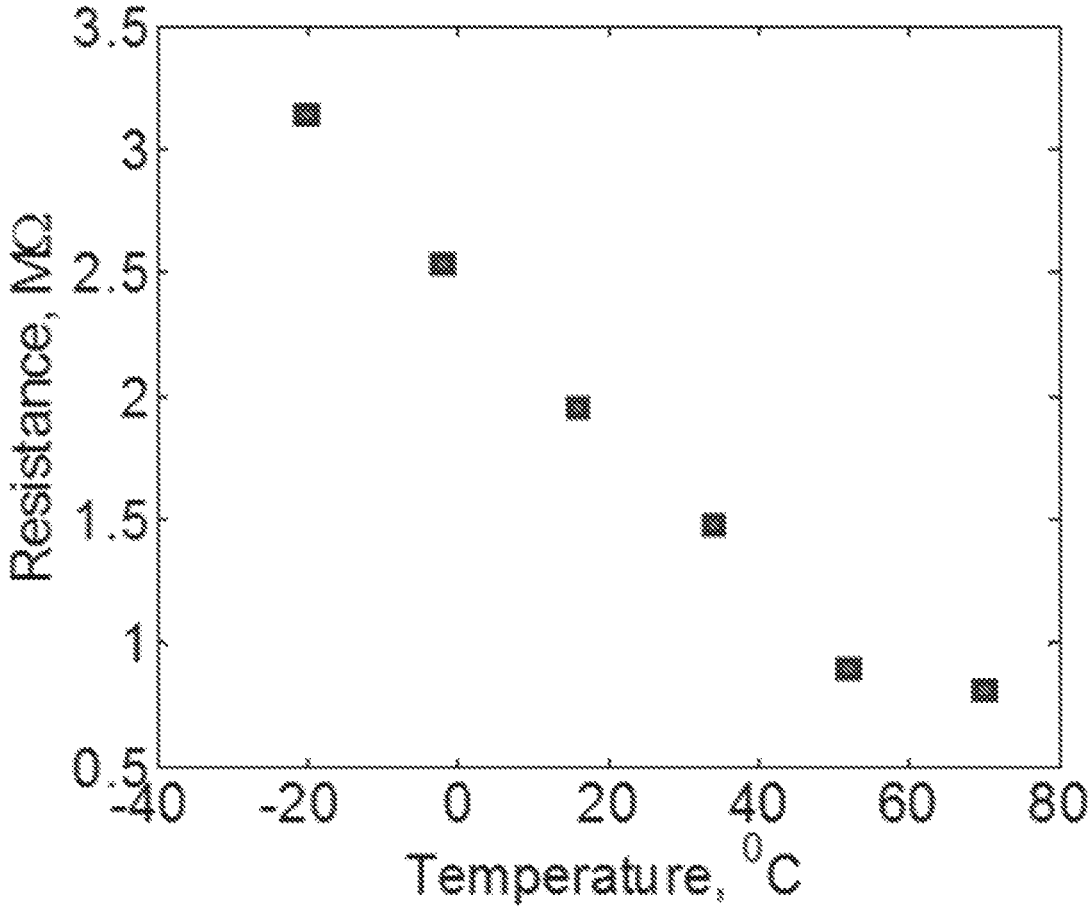
FIG. 5 illustrates a characterization of a temperature sensor of the wireless environmental monitoring system, according to various embodiments of the present disclosure.

The gas sensor 112 can be printed, via an inkjet printer, to the second side panel 103*b*. The gas sensor 112 can comprise a resistive sensor which is formed by printing carbon nanotube ink. The gas sensor 112 can be fully fabricated via an inkjet printer. In some embodiments, the gas sensor 112 can detect gas levels as low as 6 ppm (FIG. 4). The temperature sensor 115 can be printed, via an inkjet printer, to the first side panel 103*a*. The temperature sensor 115 can comprise a resistive sensor which is realized by printing with polymer ink (PEDOT: PSS). The temperature sensor 115 can be fully fabricated via the inkjet printer. In some embodiments, the temperature sensor 115 has a response that is nearly linear in the range of −20° C. to 70° C. (FIG. 5). The placement of the gas sensor 112 and the temperature sensor 115 can vary. In some embodiments, the temperature sensor 115 and the gas sensor 112 can be positioned on the same side panel 103. In some cases, the wireless environmental monitoring system 100 can include multiple temperature sensors 115, each temperature sensor 115 being positioned on a different side panel 103.

The humidity sensor 118 can also be printed, via an inkjet printer, to the printed circuit board 121. The humidity sensor 118 can comprise an air capacitor sensor that measures the dielectric constant of air. The humidity sensor 118 can have an air cavity through which air is measured. The printed circuit board 121 can be attached to the side panels 103. In some embodiments, the printed circuit board 121 can be a two layer circuit board made on a 3D printed substrate using silver-organo-complex (AOC) ink and a commercial dielectric ink (VeroBlack). The printed circuit board 121 can include the wireless transceiver 124, a capacitance to digital converter 127 (e.g. On Semiconductor LC717A00AJ), a resistance to voltage converter, a battery, and other suitable electronic circuits for a portable device. The capacitance to digital converter 127 can convert a capacitance output from the humidity sensor 118 to a digital signal for the computing device embedded within the wireless transceiver 124.

Various electronic components of the wireless environmental monitoring systems 100 can be realized by using 3D inkjet printing techniques. These techniques enable a greater degree of integration compared to previous solutions, which results in a smaller form-factor than existing solutions. As one non-limiting example, FIG. 1 illustrates the wireless environmental monitoring systems 100 having the dimensions of about 2 cm×2 cm×2 cm. In addition, the 3D inkjet printing techniques enable for the wireless environmental monitoring systems 100 to be manufactured at a lower cost than existing solutions of similar functionality.

Next, a general description of the operation of the various components of the wireless environmental monitoring system 100 is provided. To begin, one or multiple wireless environmental monitoring systems 100 can be in wireless communication with a remote computing device. The wireless environmental monitoring systems 100 can be positioned in strategic locations outdoors and/or indoors. For example, the wireless environmental monitoring systems 100 can be positioned in an environment setting where there is concern of forest fires. Once positioned, the wireless environmental monitoring system 100 can measure environmental conditions in the surrounding area, such as temperature, gas levels, and humidity levels. The wireless environmental monitoring system 100 can be configured with a threshold for a respective environmental condition.

As one non-limiting example, the wireless environmental monitoring system 100 can have a temperature threshold. Once a temperature measurement reaches the temperature threshold, the wireless environmental monitoring system 100 can transmit an environmental alert to the remote computing device. Similar thresholds can be configured for the gas and humidity measurements.

In another non-limiting example, the wireless environmental monitoring system 100 can take measurements of the environmental conditions and transmit the measurements to the remote computing device in real-time (or substantially in real-time). Alternatively, the wireless environmental monitoring system 100 can transmit the environmental measurements at a periodic interval. In some embodiments, the wireless environmental monitoring system 100 can store the measurements in a memory.

Figure 2:
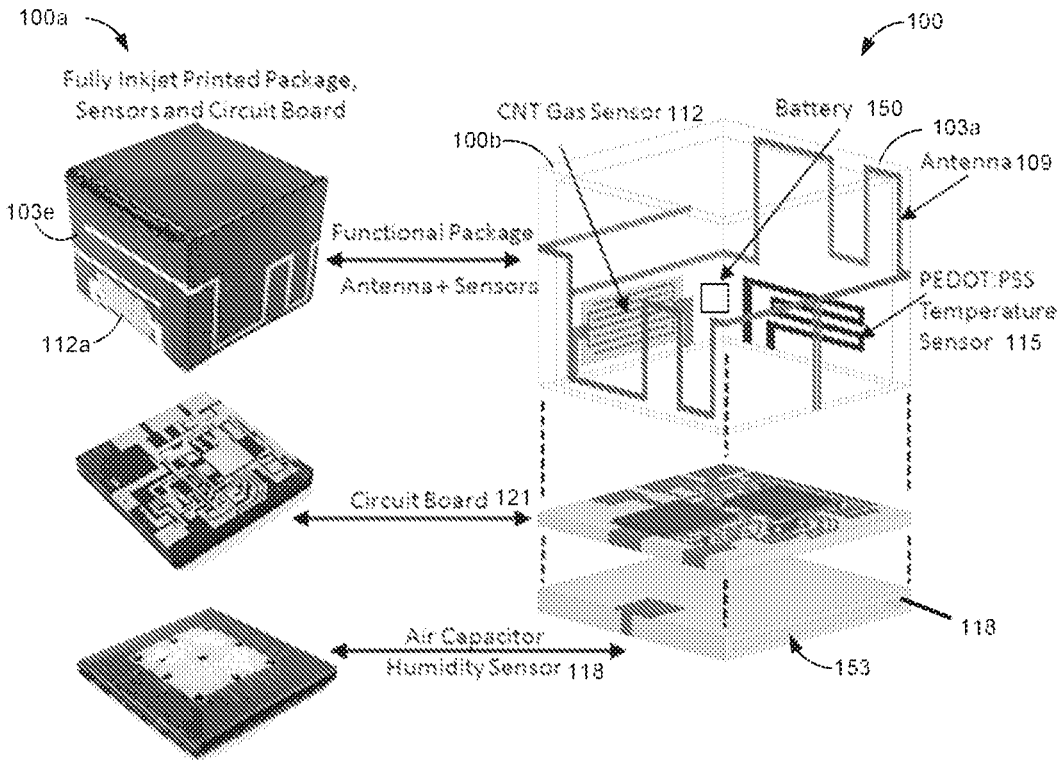
FIG. 2 illustrates exploded views of the wireless environmental monitoring system in FIG. 1, according to various embodiments of the present disclosure.

With respect to FIG. 2, shown are exploded views of the wireless environmental monitoring system 100. In particular, FIG. 2 illustrates the wireless environmental monitoring system 100, shown in FIG. 1, in a first exploded view and a second exploded view of a prototype 100*a*. In the illustrated embodiment, the wireless environmental monitoring system 100 also includes a battery 150. The battery 150 is configured to power the various electronic components of the wireless environmental monitoring system 100.

In one embodiment, the wireless environmental monitoring system 100 can be designed to be a lightweight, small, and low cost monitoring system. In this scenario, the battery 150 can comprise, for example, a flexible battery. A flexible battery, for example, can be capable of being folded or bent without compromising the integrity of the battery. Such batteries can be printed using nanotube ink or can be commercially available (e.g., flexible lithium-ion, flexible nickel-cadmium batteries, etc.). Thus, the battery 150 can be printed on one of the side panels 103.

In addition, the first exploded view and the second exploded view of the prototype 100*a* provide an indication of how the wireless environmental monitoring system 100 is assembled. The first exploded view and the second exploded view illustrate that various electronic components can be printed to an exterior portion of the side panels 103. As one can appreciate, the circuits and electronic components can be printed on interior portions of the wireless environmental monitoring system 100 as well.

In one embodiment, the side panels 103 can be integrated to form an enclosure. In this case, the enclosure can be fabricated, as a single structure, using 3D inkjet printing techniques. In addition, during the 3D inkjet printing process, the various electronic components, such as the antenna 109, the temperature sensor 115, the gas sensor 112, and other electronic components, can be printed onto the side panels 103. In one non-limiting example, after the enclosure is fabricated, the enclosure can be positioned at different orientations. The different orientations can enable a printer head to print the various electronic components and associated circuits on each of the side panels 103. In another non-limiting example, the various electronic components and associated circuits can be printed onto the enclosure during its fabrication.

In another embodiment, the side panels 103 can be formed from a single panel. Particularly, the various electronic components (e.g., the antenna 109, the temperature sensor 115, the gas sensor 112, and other electronic components) are printed on the single panel. The single panel can be folded at one or more locations to form the side panels 103. Then, a first end of the single panel can be electrically aligned and attached to a second end of the single panel, which forms an enclosure. For example, a single panel can be folded at three locations to form four side panels 103. The first side panel 103*a* can then be electrically aligned and attached to the second side panel 103*b*. In another embodiment, the side panels 103 are separate panels that are electrically aligned and attached to each other.

As discussed above, the antenna 109 can be printed onto some or all of the side panels 103. In some embodiments, as shown in the prototype 100*a*, the antenna 109 is printed on an exterior portion of the side panels 103*e*. The prototype 100*a* also illustrates the gas sensor 112*a* being printed on the exterior of the side panel 103*e*. Although not shown in the prototype 100*a*, the temperature sensor 115 (as shown in the wireless environmental monitoring system 100 of FIGS. 1 and 2) can also be printed on the exterior of one of the side panels 103*e*.

Next, the printed circuit board 121 can be attached to the side panels 103. When attached to the side panels 103, the printed circuit board 121 is electrically coupled to the electronic components attached to the side panels 103. In some embodiments, the printed circuit board 121 can be aligned with a particular orientation of the side panels 103 in order to align one or more electrical connections on the printed circuit board 121 to one or more electrical connections associated with the various electronic components attached to the side panels 103, such as the antenna 109, the temperature sensor 115, the gas sensor 112, and other electronic components.

In addition, the printed circuit board 121 can be attached to the humidity sensor 118. The printed circuit board 121 can be aligned with the humidity sensor 118 such that an electrical connection associated with the printed circuit board 121 is coupled to an electrical connection associated the humidity sensor 118. In some embodiments, the alignment of the humidity sensor 118 can also depend on an appropriate orientation that provides sufficient air flow for the air cavity 153 associated with the humidity sensor 118.

Figure 3:
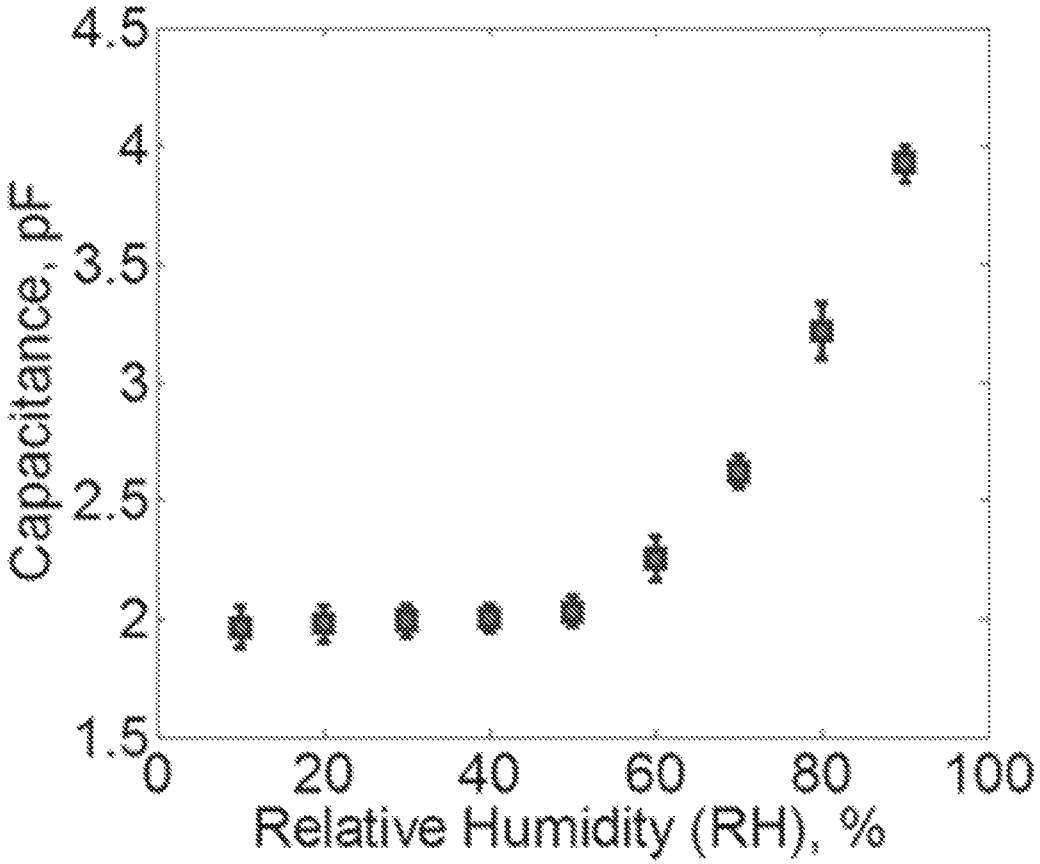
FIG. 3 illustrates a characterization of a humidity sensor of the wireless environmental monitoring system, according to various embodiments of the present disclosure.

Further, the prototype 100*a* of the wireless environmental monitoring system 100 was developed to take environment condition measurements, as shown in FIGS. 3-5. The humidity sensor 118, the gas sensor 112, and the temperature sensor 115 were characterized, and the results are shown in FIGS. 3-5, respectively.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., % 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, the following is claimed:

1. An apparatus, comprising:

a printed circuit board;

a computing device attached to the printed circuit board;

a wireless transmitter attached to the printed circuit board and coupled to the computing device;

a plurality of side panels connected to the printed circuit board to form an enclosure;

a fully inkjet-printed sensor coupled to at least one of the plurality of side panels of the apparatus, the fully inkjet-printed sensor being in data communication with the computing device, the fully inkjet-printed sensor being used to monitor an environmental condition;

a humidity sensor attached to the printed circuit board, outside the enclosure, to measure a humidity; and an antenna printed on at least one of the plurality of side panels, the antenna being coupled to the printed circuit board and to the wireless transmitter, the wireless transmitter being configured to provide wireless communication of the environmental condition, via the antenna, to a remote computing device.

2. The apparatus of claim 1, wherein the environmental condition is temperature, and wherein the fully inkjet-printed sensor comprises a resistive sensor that is formed by printing polymer ink.

3. The apparatus of claim 1, wherein the environmental condition is a gas level, and wherein the fully inkjet-printed sensor comprises a resistive sensor that is formed by printing carbon nanotube ink.

4. The apparatus of claim 1, wherein the humidity sensor is an air capacitive sensor coupled to the printed circuit board to form an air cavity.

5. A method of assembling a wireless sensor device for monitoring an environmental condition comprising:

printing, using an inkjet printer, an enclosure comprising a plurality of side panels, wherein printing the enclosure comprises:

printing a temperature sensor and a gas sensor onto at least one of the plurality of side panels; and printing an antenna onto at least one of the plurality of side panels;

attaching the plurality of side panels to a printed circuit board panel that comprises a computing device and a wireless transmitter, where attaching the plurality of side panels aligns a first electrical connection associated with the printed circuit board panel to a second electrical connection associated with the plurality of side panels, the computing device being in data communication with the temperature sensor, the gas sensor, and the wireless transmitter, wherein the wireless transmitter is coupled to the antenna; and attaching a humidity sensor to the printed circuit board panel, outside the enclosure, to measure a humidity.

6. The method of claim 5, wherein the humidity sensor is an air capacitor sensor coupled to the printed circuit board panel.

7. The method of claim 6, wherein the air capacity sensor defines an air cavity with the printed circuit board panel, outside the enclosure.

8. The method of claim 5, wherein the inkjet printer comprises a 3D inkjet printer, and wherein the temperature sensor and the gas sensor are entirely fabricated using the 3D inkjet printer.

9. The method of claim 5, wherein the plurality of side panels are substantially the same dimensions.

10. A system, comprising:

a printed circuit board;

a wireless transmitter attached to the printed circuit board;

an enclosure at least partially formed from a plurality of side panels that are attached to the printed circuit board;

an inkjet-printed sensor coupled to at least one of the plurality of side panels, the inkjet-printed sensor being used to provide a measurement of an environmental condition;

a humidity sensor attached to the printed circuit board, outside the enclosure, to measure a humidity; and a computing device coupled to the wireless transmitter and coupled to the inkjet-printed sensor, the computing device formed on the printed circuit board and configured to transmit, via the wireless transmitter, the measurement to a remote computing device.

11. The system of claim 10, wherein the enclosure comprises a cube shape.

12. The system of claim 10, wherein the humidity sensor includes an air capacitive sensor electrically coupled to the computing device.

13. The system of claim 12, wherein the air capacitive sensor forms an air cavity with the printed circuit board.

14. The system of claim 10, further comprising an antenna printed on at least one of the plurality of side panels, the antenna being coupled to the wireless transmitter.

15. The system of claim 10, where the computing device is configured to determine that the measurement exceeds a threshold associated with the environment condition.

16. The system of claim 10, wherein the inkjet-printed sensor is printed onto the at least one of the plurality of side panels via polymer ink.

17. The system of claim 10, wherein the plurality of side panels are formed by folding at least one panel.

18. The system of claim 10, wherein the inkjet-printed sensor is coupled to the at least one of the plurality of side panels via adhesive tape.

19. The system of claim 10, further comprising a printed battery coupled to the at least one of the plurality of side panels, wherein the printed battery is electrically coupled to the computing device and the wireless transmitter.

* * * * *